US007125263B2

(12) United States Patent
Rho

(10) Patent No.: US 7,125,263 B2
(45) Date of Patent: Oct. 24, 2006

(54) JUNCTION BOX ASSEMBLY

(75) Inventor: Suk Young Rho, Anyang (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 11/346,939

(22) Filed: Feb. 3, 2006

(65) Prior Publication Data

US 2006/0128182 A1 Jun. 15, 2006

Related U.S. Application Data

(62) Division of application No. 10/998,522, filed on Nov. 29, 2004.

(30) Foreign Application Priority Data

Dec. 2, 2003 (KR) ..... 10-2003-0086630
May 18, 2004 (KR) ..... 10-2004-0035157

(51) Int. Cl.
*H01R 13/62* (2006.01)

(52) U.S. Cl. ..... 439/76.2; 439/157

(58) Field of Classification Search ..... 439/76.2, 439/157, 347, 949
See application file for complete search history.

(56) References Cited

U.S. PATENT DOCUMENTS 4,586,771 A * 5/1986 Kraemer et al. ..... 439/325
5,183,408 A 2/1993 Hatagishi
5,326,274 A 7/1994 Pfaff et al.
5,618,195 A 4/1997 Cappe
5,857,859 A 1/1999 Machill et al.
5,876,226 A 3/1999 Tsukakoshi et al.
5,899,762 A 5/1999 Ainceri
6,045,375 A 4/2000 Aoki et al.
6,062,882 A 5/2000 Hanazaki et al.
6,083,017 A 7/2000 Matsumura
6,142,826 A 11/2000 Bourillon
6,155,850 A 12/2000 Martin et al.
6,193,530 B1 2/2001 Sakurai et al.
6,244,880 B1 6/2001 Fukase et al.
6,254,407 B1 7/2001 Burns
6,305,957 B1 10/2001 Fink et al.
6,361,336 B1 3/2002 Zhao et al.
6,361,362 B1 3/2002 Kressmann et al.
6,382,992 B1 5/2002 Bouchan et al.
6,641,423 B1 11/2003 Giro
6,733,314 B1 5/2004 Konda
2002/0090849 A1 7/2002 Shuey et al.
2003/0216071 A1 11/2003 Katsuma
2005/0159034 A1 7/2005 Murayama et al.

* cited by examiner

*Primary Examiner*—Gary F. Paumen
(74) *Attorney, Agent, or Firm*—Morgan Lewis & Bockius LLP

(57) ABSTRACT

A junction box assembly includes a main body on which an electric circuit is disposed having at least one socket electrically connected to the electric circuit. A first cover covers a surface of the main body on which the electric circuit is disposed. A second cover covers another surface of the main body opposite the first surface and has a connector corresponding to the at least one socket. A coupling unit fastens the main body and the second cover together by a sliding motion thereof, such that the socket and the connector are coupled to each other.

5 Claims, 11 Drawing Sheets

JUNCTION BOX ASSEMBLY

CROSS-REFERENCE TO RELATED APPLICATIONS

This is a divisional application of copending U.S. application Ser. No. 10/998,522, filed Nov. 29, 2004, which claims priority of Korean Application No. 10-2003-0086630, filed Dec. 2, 2003, and Korean Application No. 10-2004-0035157, filed May 18, 2004, the disclosures of which are incorporated herein by reference.

FIELD OF THE INVENTION

Generally, the present invention relates to a junction box for electric circuits. More particularly, the present invention relates to a junction box assembly for vehicles that can be easily and precisely assembled.

BACKGROUND OF THE INVENTION

Generally, a junction box is employed in vehicles for gathering of electric circuits in a convenient location. Such a conventional junction box typically includes a main body on which electric circuits are disposed, an upper cover for covering an upper portion of the main body, and a lower cover for covering a lower portion of the main body. Sockets are provided at the lower portion of the main body for electrical connection to the various electric circuits. Connectors are provided at an upper portion of the lower cover and are electrically connected to respective sockets. In a conventional junction box, in order to couple the sockets of the main body to the connector of the lower cover, the lower cover is coupled to the main body by a bolt and a bolt inserted therethrough.

However, the above-mentioned conventional junction box presents certain difficulaties when the junction box is assembled and disassembled. Firstly, when the junction box is mass-produced, since a separate bolting device is required for fastening the connecting bolt, excessive cost and time are required. In addition, the bolting process progresses regardless of whether the connector is accurately coupled to the socket, and accordingly, incorrect assembly may occur.

When the junction box is repaired, since the bolt must be unfastened and fastened by a separate screw driver, the repair process can be complicated. In addition, because of the use of a bolt(s), the bolt(s) may be unfastened by vibration thereof, which is always present in vehicles.

The information disclosed in this Background of the Invention section is only for enhancement of understanding of the background of the invention and should not be taken as an acknowledgement or any form of suggestion that this information forms the prior art that is already known in this country to a person of ordinary skill in the art.

SUMMARY OF THE INVENTION

Embodiments of the present invention provide a junction box assembly having non-limiting advantages of being easily and precisely assembled, allowing for less complicated repair and greater vibration resistance.

An exemplary junction box assembly according to one embodiment of the present invention includes a main body on which an electric circuit is disposed, having at least one socket electrically connected to the electric circuit. A first cover covers a surface of the main body on which the electric circuit is disposed. A second cover covers another, opposite surface of the main body, and has a connector corresponding to the at least one socket. A coupling unit fastens the main body and the second cover together by a sliding motion thereof, such that the socket and the connector are coupled to each other.

In a further embodiment according to the present invention, as a first example, the coupling unit includes a slider, at least one guide projection and a projection sliding portion the slider is slidably disposed on the second cover. The at least one guide projection is disposed on a side of the slider. The projection sliding portion is disposed on the main body correspondingly to the guide projection, and has a slot inclined at a predetermined angle such that the projection sliding portion perpendicularly moves with respect to a movement direction of the guide projection according to a movement of the slider.

In another further embodiment according to the present invention, in a variation of the first example, the coupling unit includes similar components with a slider slidably disposed on the main body and at least one guide projection disposed on a side of the slider. A projection sliding portion is also disposed on the second cover corresponding to the guide projection. The projection sliding portion has a slot inclined at a predetermined angle such that the projection sliding portion perpendicularly moves with respect to a movement direction of the guide projection according to a movement of the slider.

In another further embodiment according to the present invention, as a second example, the coupling unit includes: at least one guide projection disposed on the second cover, a slider slidably disposed on the main body corresponding to the guide projection, and a projection sliding portion. The sliding portion is disposed on the slider corresponding to the guide projection and has a slot inclined at a predetermined angle such that the guide projection perpendicularly moves with respect to a movement direction of the slider according to movement of the slider.

In another further embodiment according to the present invention, in a variation of the second example, the coupling unit includes at least one guide projection disposed on the main body, a slider slidably disposed on the second cover corresponding to the guide projection, and a projection sliding portion disposed on the slider corresponding to the guide projection. The projection sliding portion has a slot inclined at a predetermined angle such that the guide projection perpendicularly moves with respect to a movement direction of the slider according to a movement of the slider.

In another further embodiment according to the present invention, an insertion cavity with a depth corresponding at least approximately to the projecting length of the guide projection is further formed at the projection sliding portion. The guide projection thus may be smoothly inserted in the projection sliding portion for assembly.

In another further embodiment according to the present invention, the predetermined angle of the slot is an angle that enables the socket of the main body and the connector of the second cover to be coupled together by a movement of the slider after the guide projection is inserted to the slot.

In another further embodiment according to the present invention, the coupling unit further includes a pressing portion for moving the slider.

In another further embodiment according to the present invention, the pressing portion includes a direct pressing lever provided to an end of the slider in order to directly move the slider.

In another further embodiment according to the present invention, the coupling unit further includes a separation preventing portion that prevents separation of the slider from the junction box when the junction box is disassembled.

In another further embodiment according to the present invention, the coupling unit further includes a locking portion such that the slider is not moved by an external vibration after the junction box is assembled.

In another further embodiment according to the present invention, a pressing direction of the direct pressing lever is either a left direction or a right direction with respect to the main body.

In another further embodiment according to the present invention, as another example, the pressing portion includes a linking bar having an end pivotally coupled to an end of the slider by a dynamic axle, and an indirect pressing lever fixed to another end of the linking bar with a predetermined angle therebetween. The fixed portion is pivotally coupled to either of the main body or the second cover by a stationary axle, such that, when the indirect pressing lever is pressed, the linking bar rotates with respect to the stationary axle and accordingly moves the dynamic axle and the slider.

In another further embodiment according to the present invention, the pressing direction of the indirect pressing lever is either an upward direction or a downward direction with respect to the main body. The movement direction of the dynamic axle and the slider, according to the upward or the downward direction, is either a left direction or a right direction with respect to the main body.

In another further embodiment according to the present invention, an insertion slot is further formed at the end of the slider, such that the dynamic axle is inserted therein and is movable in a predetermined distance.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

An embodiment of the present invention will hereinafter be described in detail with reference to the accompanying drawings.

Figure 1:
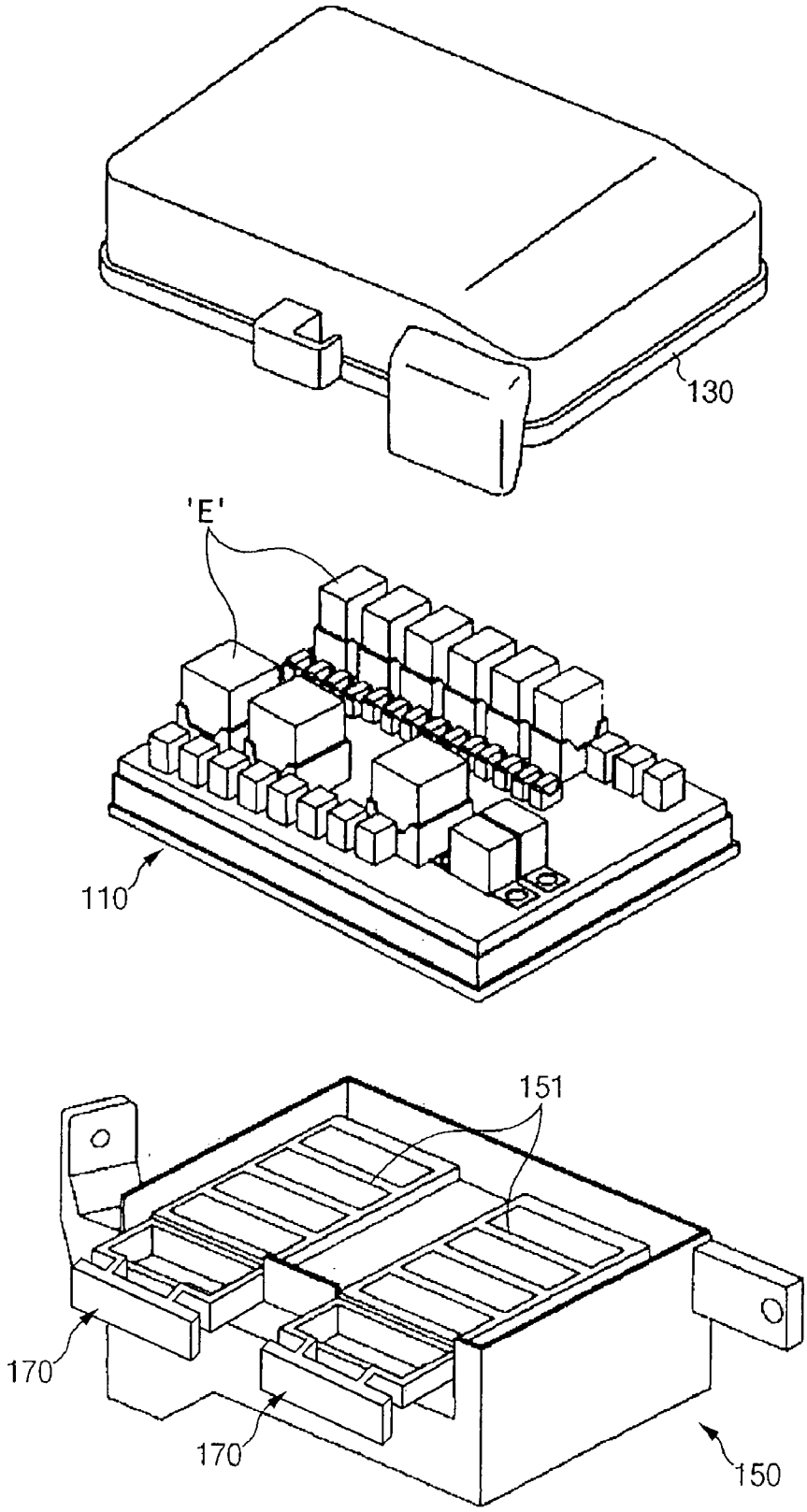
FIG. 1 is an exploded perspective view showing a junction box assembly according to a first embodiment of the present invention.
Figure 2:
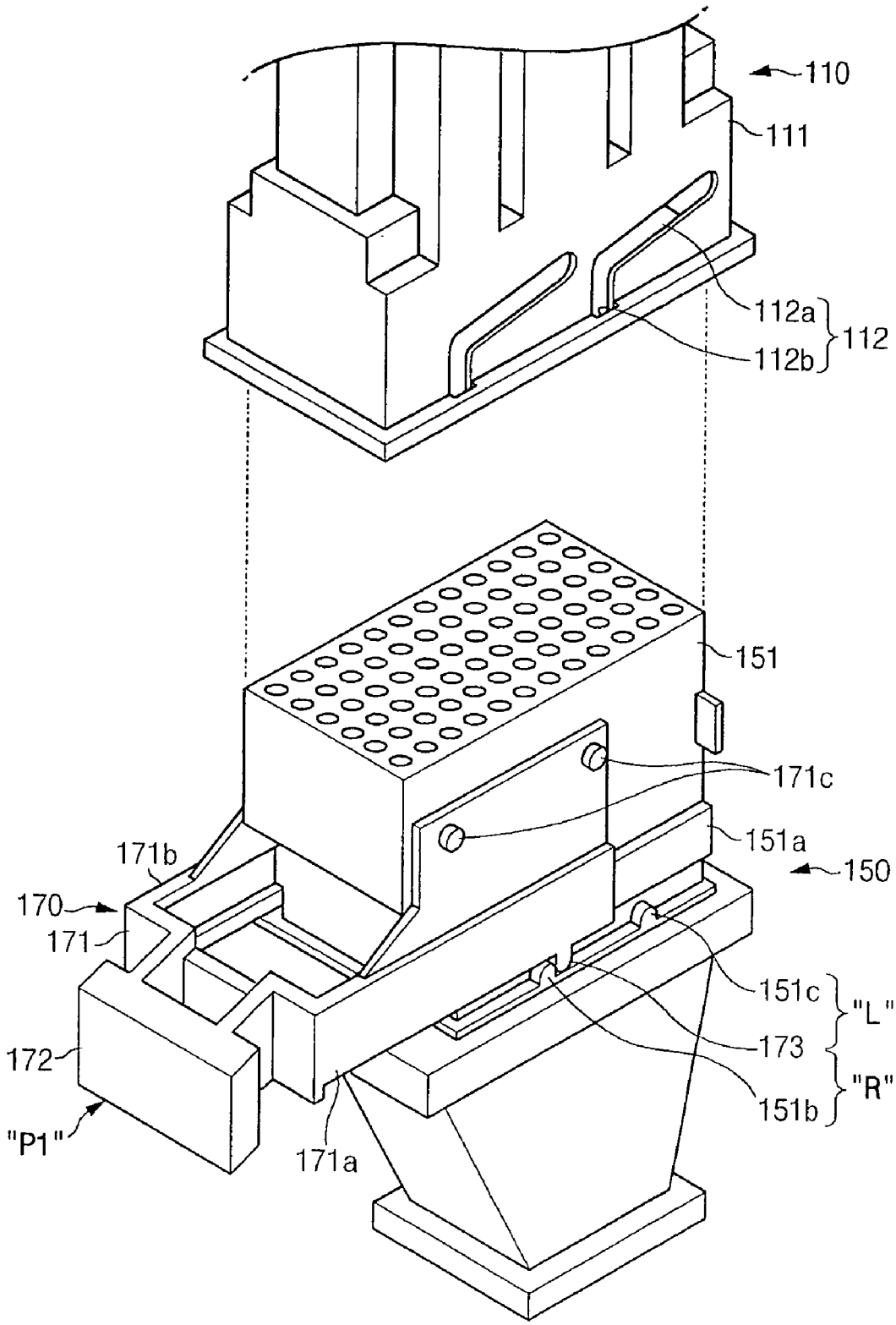
FIG. 2 is a perspective view showing principal portions of a junction box assembly according to the first embodiment of the present invention in a state that a socket and a connector are decoupled.

As shown in FIGS. 1 and 2, a junction box assembly according to a first embodiment of the present invention includes: a main body 110; a first cover 130; a second cover 150; and a coupling unit 170. An electric circuit E is disposed on the main body 110 and the main body 110 has at least one socket 111 electrically connected to the electric circuit E. The first cover 130 covers a surface of the main body 110, on which the electric circuit E is disposed. The second cover 150 covers another surface of the main body 110 opposite the surface on which the electric circuit E is disposed, and has a connector 151 corresponding to the at least one socket 111. The coupling unit 170 fastens the main body 110 and the second cover 150 together by a sliding motion thereof, such that the socket 111 and the connector 151 are coupled to each other.

In one embodiment, the coupling unit 170 may include a slider 171 slidably disposed on the second cover 150, at least one guide projection 171*c* disposed on a side of the slider 171, and a projection sliding portion 112 disposed on the main body 110 corresponding to the guide projection 171*c*. The sliding portion 112 defines a slot 112*a* inclined at a predetermined angle such that the projection sliding portion 112 perpendicularly moves with respect to the direction of movement of the guide projection according to the movement of the slider 150. It is preferable that the slider 171 be slidably disposed on an outside surface of the connector 151 of the second cover 150.

Furthermore, the connector 151 of the second cover 150 (hereinafter called "lower cover," for convenience) and the socket 111 of the main body 110 can be partitioned into a plurality of sections if necessary. If the connector 151 is so partitioned, the slider 171 either can be respectively disposed on the plurality of connectors, or can be disposed on an outside surface of an outermost connector.

If the slider 171 is respectively disposed on the plurality of connectors 151, as shown in FIG. 2, branches 171*a* and 171*b* of the slider 171 are respectively disposed on an outside, opposed surface of the connector 151. Rails 151*a* are respectively formed at the opposed outside surfaces and guiders (not visible in FIG. 2) are respectively formed at each inside surface of the branches 171*a* and 171*b* of the slider 171 such that the rails 151*a* slide therealong. Guide projection 171*c* projects from an outside surface of the slider 171, and the slot 112*a* of the projection sliding portion 112 is formed at the socket 111.

In addition, it is preferable that an insertion cavity 112*b*, with a depth corresponding to the projecting length of the guide projection 171*c*, is further formed in the projection sliding portion 112, such that the guide projection 171*c* may be smoothly inserted in the projection sliding portion 112 for assembly. The predetermined angle of the slot 112*a* may be an angle that enables the socket 111 of the main body 110 and the connector 151 of the lower cover 150 to be coupled together by movement of the slider 171 after the guide projection 171*c* is inserted to the slot 112*a*.

It is also preferable that the coupling unit 170 further include a pressing portion P1 for moving the slider 171. The pressing portion P1 may include a direct pressing lever provided to an end of the slider 171 in order to directly move the slider 171. The pressing direction of the direct pressing lever 172 and a movement direction of the slider 171 may be either a left direction or a right direction with respect to the main body 110.

If direct pressing lever 172 is employed, it is preferable that the coupling unit 170 further includes a separation preventing portion R that prevents separation of the slider 171 from the connector 151 when the junction box is disassembled. In one embodiment, the separation preventing portion R is provided with a separation preventing detent 173 formed at a side surface of the slider 171. A catch detent 151*b* is formed at a side surface of the connector 151 such that the separation preventing detent 173 is caught thereby while the slider 171 is moved a predetermined distance toward the outside when the junction box is disassembled.

In addition, if a direct pressing lever 172 is employed, it is preferable that the coupling unit 170 further include a locking portion L such that the slider 171 is not moved by vibration after the junction box is assembled. In one embodiment the locking portion L is provided with the separation preventing detent 173 preformed at the slider 171, and a locking detent 151*c* formed at one side surface of the connector 151 such that the separation preventing detent 173 is caught thereby after the junction box is assembled.

An assembly process of a junction box assembly according to the first embodiment of the present invention will hereinafter be described in detail with reference to FIGS. 3A to 3C. Thus, in one embodiment, the socket 111 may be monolithically formed at the main body 110, or may be separately provided thereat. In addition, the connector 151 may be monolithically formed at the lower cover 150, or may be separately provided thereat. Accordingly, hereinafter, an assembly process of the socket 111 of the main body 110 and the connector 151 of the lower cover 150 will centrally be described.

While described in a particular order in connection with an exemplary embodiment, assembly of embodiments of the invention may vary within the scope of the invention.

Figure 3A:
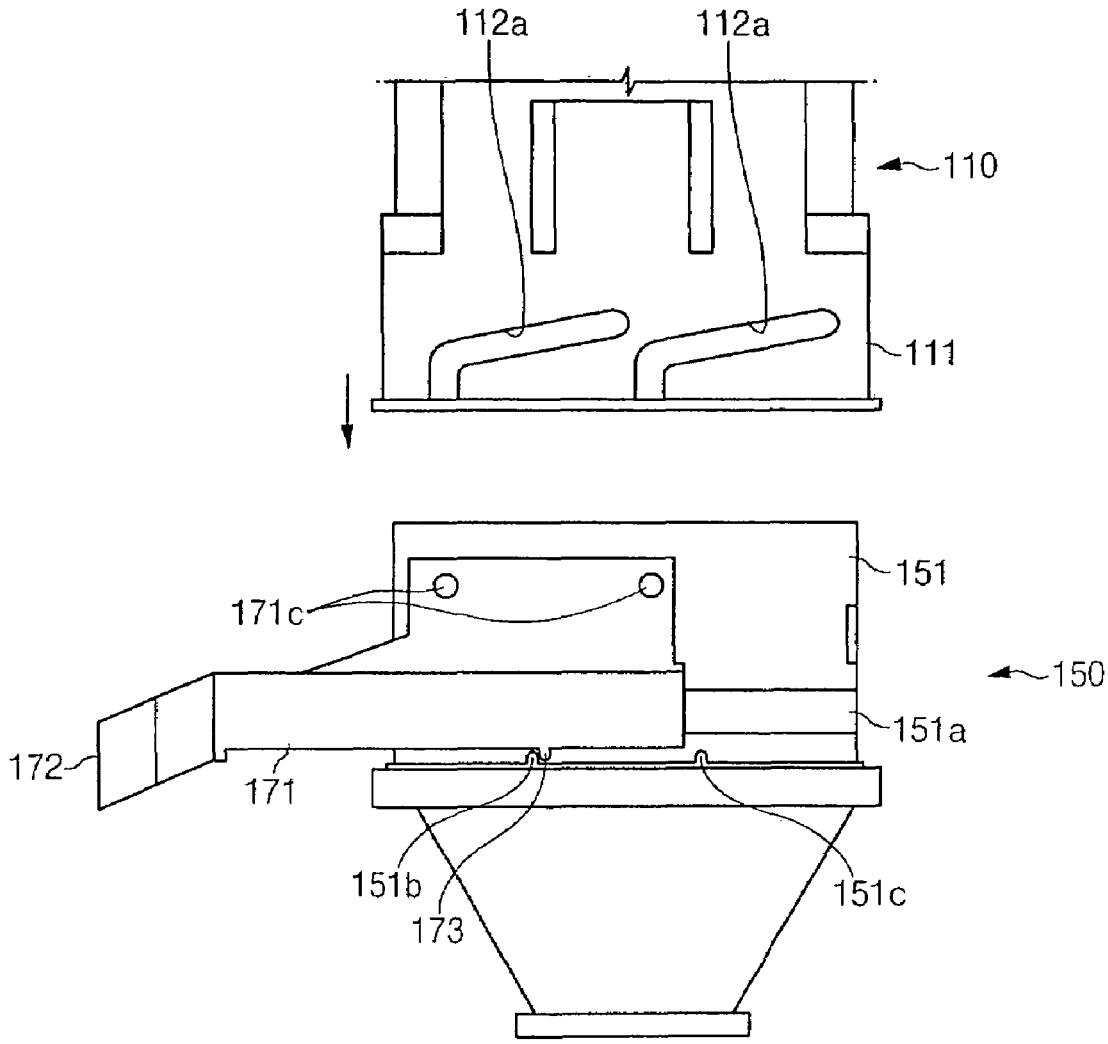
FIGS. 3A to 3C are side views of FIG. 2, and show how a socket is coupled to a connector.

Firstly, as shown in FIG. 3A, the socket 111 and the connector 151 are located correspondingly to each other. After this, the socket is moved along a direction indicated by the arrow. In addition, if the socket 111 and the connector 151 are not located correspondingly to each other, the guide projection 171*c* of the slider 171 may be smoothly inserted in the insertion cavity 112*b* at the socket 111, by a left and right movement of the socket 111.

Figure 3B:
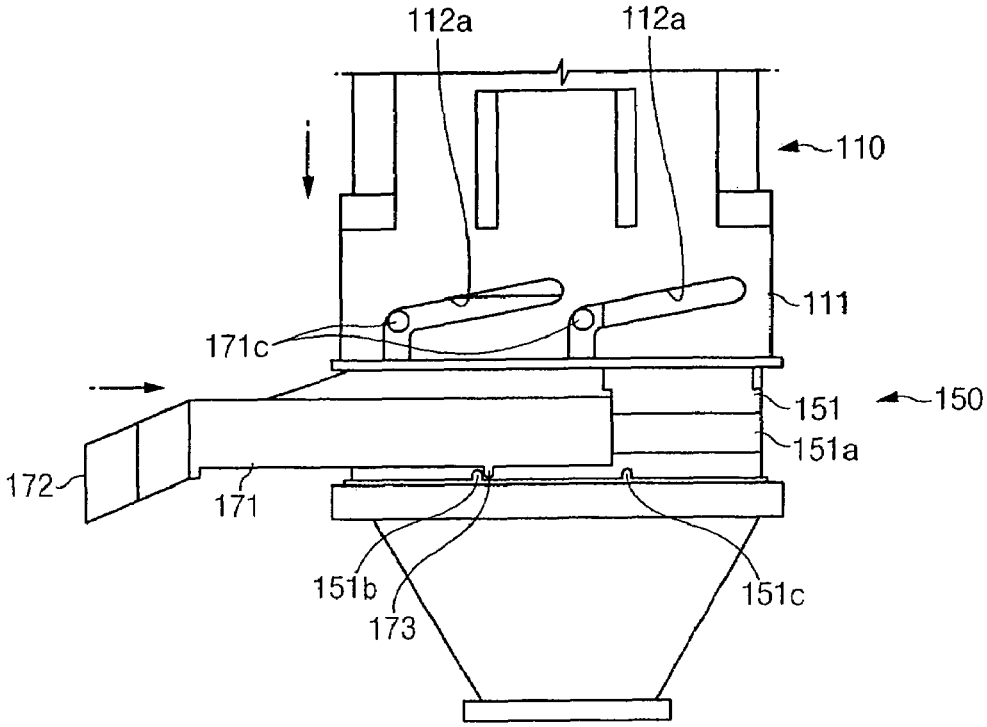

Secondly, as shown in FIG. 3B, the guide projection 171*c* of the slider 171 is disposed in the slot 112*a* through the insertion cavity (see "112*b*" in FIG. 2) at the socket 111. After this, the direct pressing lever 172 is pressurized along the direction indicated by the arrow.

Figure 3C:
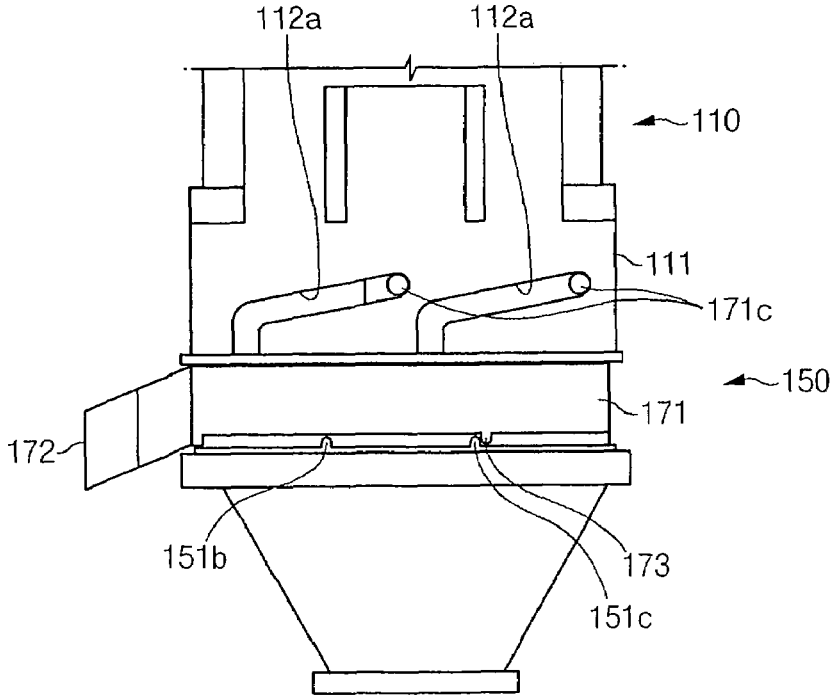

Thirdly, as shown in FIGS. 3B and 3C, if the direct pressing lever 172 is pressurized, the guider (not shown) of the slider 171 moves along the rail 151*a* of the lower cover 150. At the same time, the guide projection 171*c* formed at the slider 171 continuously moves along the slot 112*a*. The socket 111 is coupled to the connector 151 by moving toward a down direction as in FIGS. 3B and 3C. The separation preventing detent 173 of the slider 171 is caught by the locking detent 151*c* of the connector 151.

On the other hand, as shown in FIG. 2, since the guide projection 171*c* and the projection sliding portion 112 are structured to correspond to each other, changing their location will not depart from the scope of the present invention conveyed by the embodiment described thus far. For example, in the first embodiment of the present invention, the guide projection 171*c* is disposed on the slider 171, and the projection sliding portion 112 on the socket 111 of the main body. However the spirit of the present invention is realized even if the locations are changed with respect to each other, that is, even if a guide projection is provided to a socket and the projection sliding portion to a slider.

Figure 4:
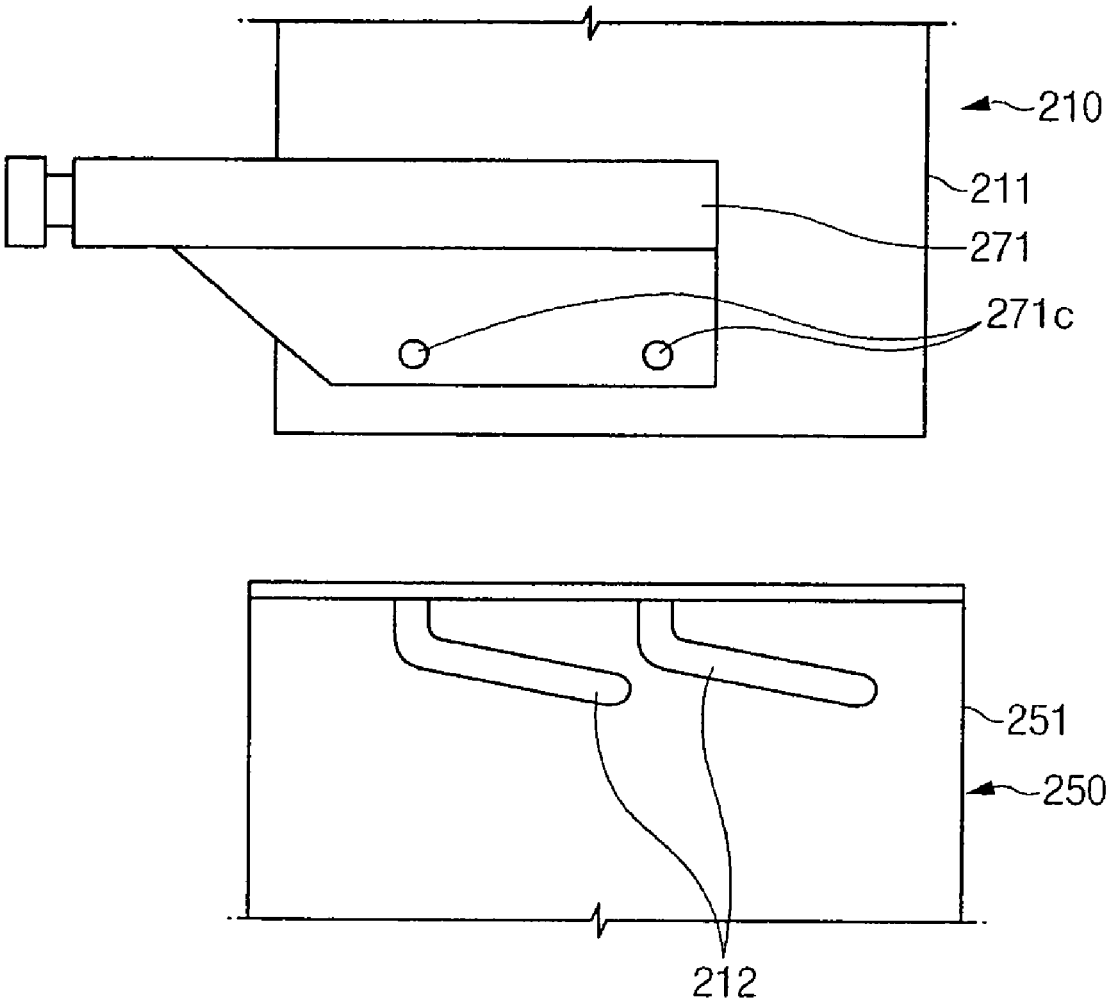
FIG. 4 is a schematic view showing a junction box assembly according to a variation of the first embodiment of the present invention.

As shown in FIG. 4, a junction box assembly according to a variation of the first embodiment of the present invention is similar to the embodiment described above, except for the location of slider 271 and location of a projection sliding portion 212. Accordingly, hereinafter, the location of a slider 271 and the location of projection sliding portion 212 will generally be described.

Firstly, the slider 271 may be disposed on a main body 210. It is preferable that the slider 271 be disposed on a socket 211 of the main body 210. The projection sliding portion 212 may be disposed on a lower cover 250 correspondingly to a guide projection 271*c* of the slider 271. It is preferable that the projection sliding portion 212 be disposed on a connector 251 of the lower cover 250. On the other hand, since an exemplary composition and assembly process can be adequately understood through a first embodiment of the present invention described above, further explanation of such will be omitted.

Figure 5:
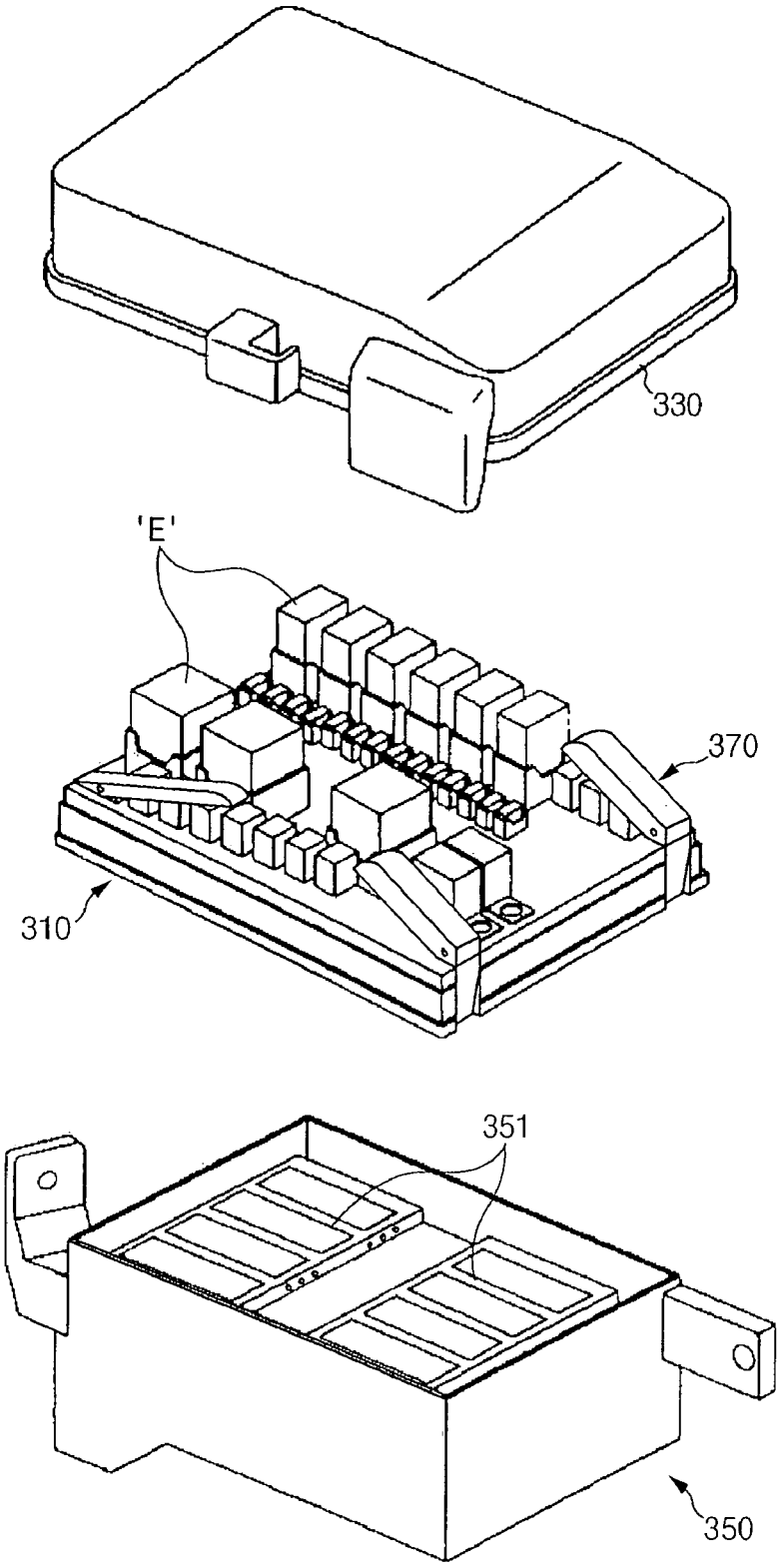
FIG. 5 is an exploded perspective view showing a junction box assembly according to a second embodiment of the present invention.
Figure 6:
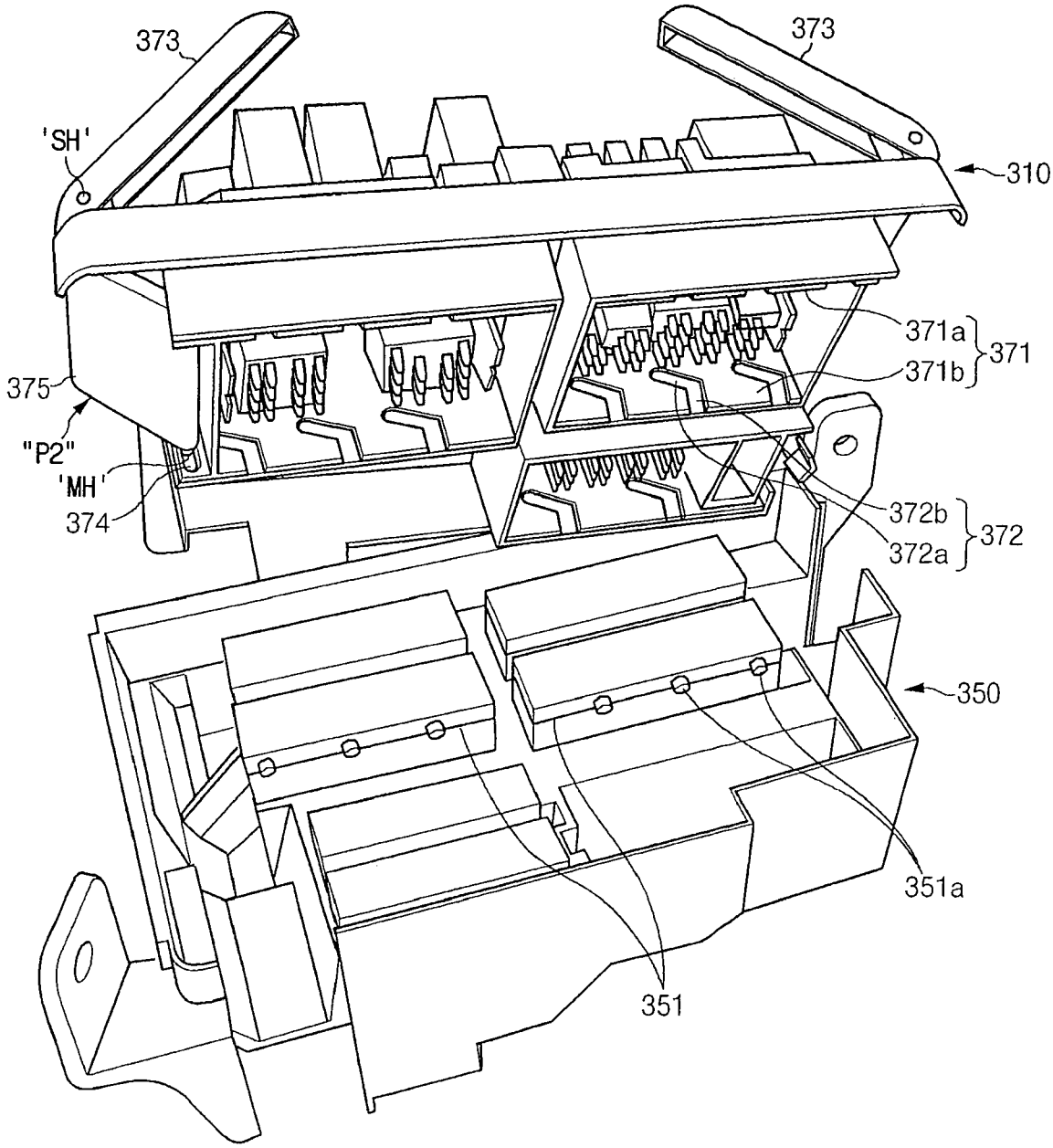
FIG. 6 is a perspective view showing principal portions of a junction box assembly according to the second embodiment of the present invention in a state that a socket and a connector are decoupled.

As shown in FIGS. 5 and 6, a junction box assembly according to a second embodiment of the present invention includes: a main body 310; a first cover 330; a second cover 350; and a coupling unit 370. An electric circuit E is disposed the main body 310 and the main body 310 has at least one socket 311 electrically connected to the electric circuit E. The first cover 330 covers a surface of the main body 310 on which the electric circuit E is disposed. The second cover 350 covers another surface of the main body 310 opposite to the surface on which the electric circuit E is disposed, and has a connector 351 corresponding to the at least one socket 311. The coupling unit 170 fastens the main body 310 and the second cover 350 together by a sliding motion thereof, such that the socket 311 and the connector 351 are coupled to each other.

The coupling unit 370 may include at least one guide projection 351*a* disposed on the second cover 350, a slider 371 slidably disposed on the main body 310 corresponding to the guide projection 351*a*, and a projection sliding portion 372 disposed on the slider corresponding to the guide projection 351*a*. Sliding portion 372 defines a slot 372*a* inclined at a predetermined angle such that the guide projection 351*a* perpendicularly moves with respect to a movement direction of the slider according to movement of the slider 371. It is preferable that the slider 371 is slidably disposed on an inside surface of the socket 311 of the main body 310.

Furthermore, the socket 311 of the main body 310 and the connector 351 of the second cover 350 (hereinafter called "lower cover," for convenience) can be partitioned in a plurality of sections if necessary. If the socket 311 is partitioned, the slider 371 can be respectively disposed on the plurality of sockets, or can be provided to an outside surface of an outermost socket.

If the slider 371 is respectively disposed on the plurality of sockets 311, as shown in FIG. 6, branches 371*a* and 371*b* of the slider 371 are respectively disposed on opposed inside surfaces of the socket 311. Rails (not visible in FIG. 6) are respectively formed at the opposed inside surfaces of the sockets 311. Guiders (also not visible) are respectively formed at each outside surface of the branches 371*a* and 371*b* of the slider 371 such that the rails are slid therealong.

In addition, guide projection 351*a* projects to an outside surface of the connector 351 of the lower cover 350, and the slot 372*a* of the projection sliding portion 372 is formed at the slider 371. It is preferable that an insertion cavity 372*b* with a depth at least approximately corresponding to the projecting length of the guide projection 351*a* is further formed at the projection sliding portion 372, such that the guide projection 351*a* can be smoothly inserted in the projection sliding portion 372 for assembly. In addition, it is preferable that the predetermined angle of the slot 372*a* is an angle that enables the socket 311 of the main body 310 and the connector 351 of the lower cover 350 to be coupled together by movement of the slider 371 after the guide projection 351*a* is inserted to the slot 372*a*.

Figure 7A:
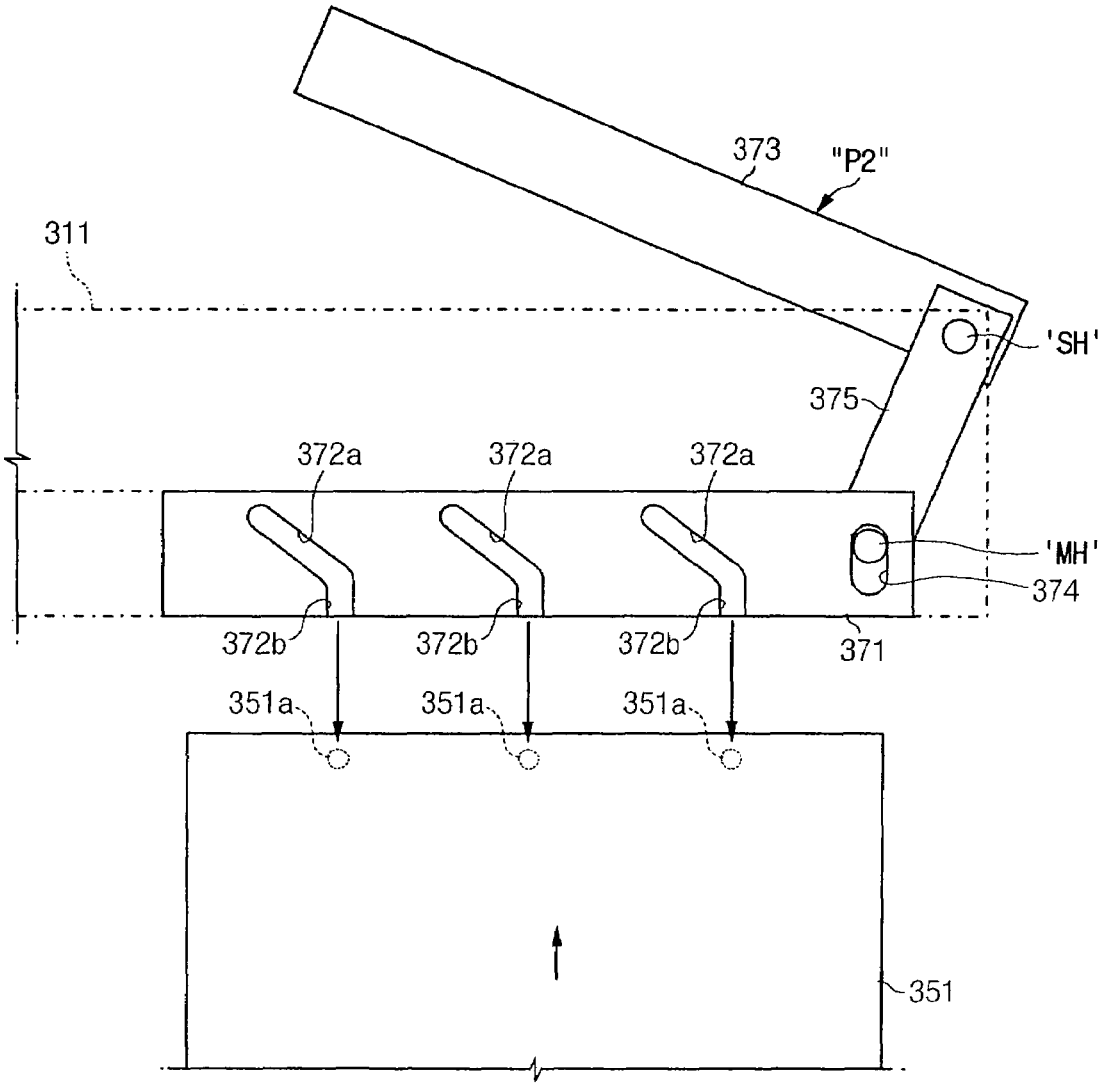
FIGS. 7A to 7C are side views of FIG. 6, and show how a socket is coupled to a connector.

It also may be preferable that the coupling unit 370 further includes a pressing portion P2 for moving the slider 371. If so, as shown in FIGS. 6 and 7*a*, the pressing portion P2 may include a linking bar 375 having an end pivotally coupled to an end of the slider 371 by a dynamic axle MH, and an indirect pressing lever 373 having an end fixed to another end of the linking bar 375. The indirect pressing lever 373 is located with respect to the linking bar 375 with an arc distance of a predetermined angle, and the fixed portion is pivotally coupled to the main body 310 by a stationary axle SH. Accordingly, when the indirect pressing lever 373 is pressed, the linking bar 375 rotates with respect to the stationary axle SH and accordingly moves the dynamic axle MH and the slider 371.

Pressing portion P2 prevents separation of the slider 371 from the socket when the junction box is disassembled, and prevents movement of the slider 371 due to external vibration after the junction box is assembled.

It may be preferable that the pressing direction of the indirect pressing lever 373 is an upward or a downward direction with respect to the main body 310, such that the indirect pressing lever 373 can avoid interference from neighboring parts when the junction box is repaired. In addition, it may be preferable that the movement direction of the dynamic axle MH and the slider 371 according to the upward or the downward direction is a left or a right direction with respect to the main body 310.

An end of the slider 371 may have an insertion slot 374, such that the dynamic axle MH is inserted therein and is movable along a predetermined distance. That is, since the dynamic axle MH is movable along the predetermined distance, straight line motion of the slider 371 is not interrupted by a circular arc motion of the dynamic axle MH with respect to the stationary axle SH.

An exemplary assembly process of a junction box assembly according to the second embodiment of the present invention will hereinafter be described in detail with reference to FIGS. 7A to 7C. In this embodiment, the socket 311 may be monolithically formed at the main body 310, or may be separately provided thereat. In addition, the connector 351 may be monolithically formed at the lower cover 350, or may be separately provided thereat. Accordingly, hereinafter, an assembly process of the socket 311 of the main body 310 and the connector 351 of the lower cover 350 will generally be described.

Firstly, as shown in FIG. 7A, the socket 311 and the connector 351 are located with respect to each other. After this, the socket 311 is moved along a direction indicated by the arrow. In addition, if the socket 311 and the connector 351 are not located properly with respect to each other, the guide projection 35 la of the connector 351 may be smoothly inserted in the insertion cavity 372*b* at the slider 371, by a left and right movement of the socket 311.

Figure 7B:
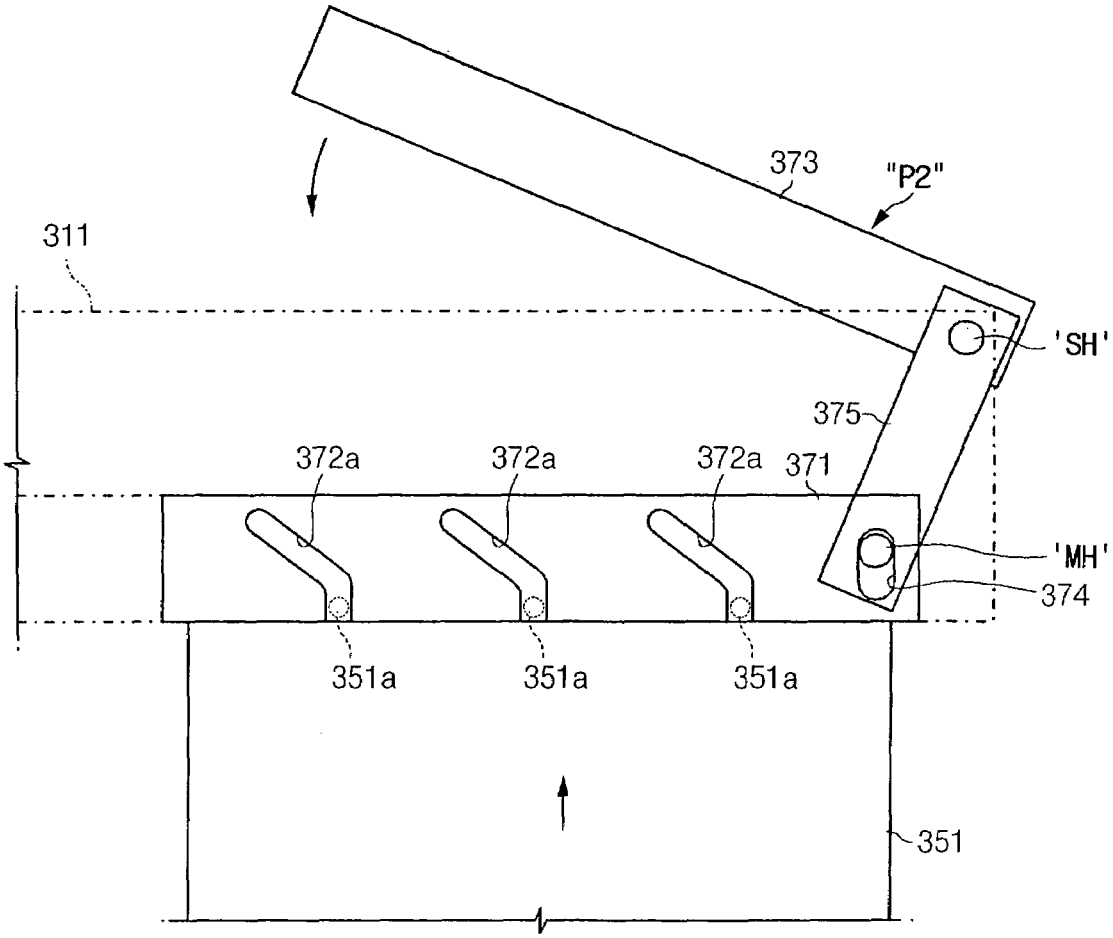

Secondly, as shown in FIG. 7B, the guide projection 351*a* of the slider 351 is disposed in the slot 372*a* through the insertion cavity 372*b* at the slider 371, after this, the indirect pressing lever 373 is pressurized along the direction indicated by the arrow.

Figure 7C:
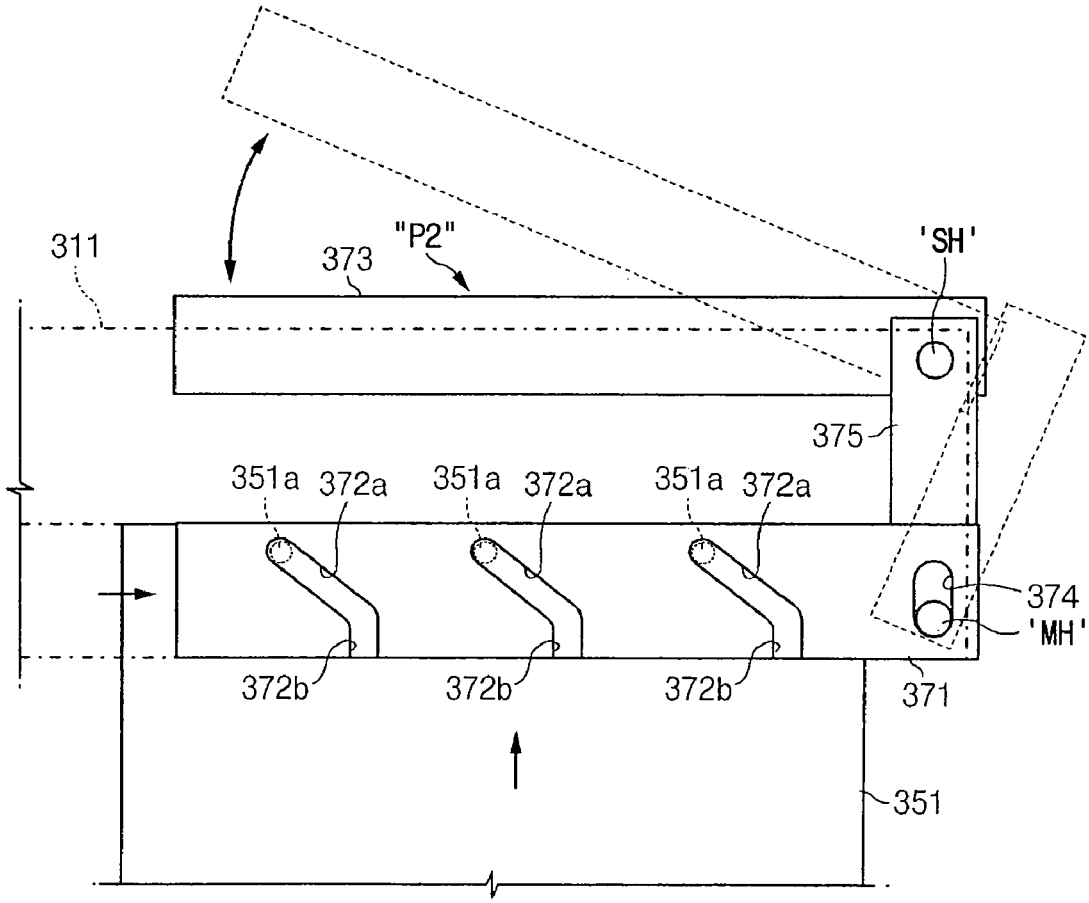

Thirdly, as shown in FIGS. 7B and 7C, if the indirect pressing lever 373 is pressurized along the direction of the upper arrow, the linking bar 375 fixed thereto moves the slider 371 in that general direction, while being rotated with respect to the stationary axle SH. At the same time, the guide projection 351*a* at the connector 351 continuously moves along the slot 372*a*. The connector 351 may be thus coupled to the socket 311 by moving toward an upper direction as in FIG. 7C.

Since the guide projection 351*a* and the projection sliding portion 372 are structured to correspond to each other, changing their locations does not depart from the scope of the present invention conveyed by the second embodiment as described above. For example, in the second embodiment of the present invention, the guide projection 351*a* is disposed on the connector 352 of the lower cover, and the projection sliding portion 372 to the slider 371, but the spirit of the present invention is still realized even if the locations are changed with respect to each other; that is, even if a guide projection is disposed on a slider and the projection sliding portion on a connector.

Figure 8:
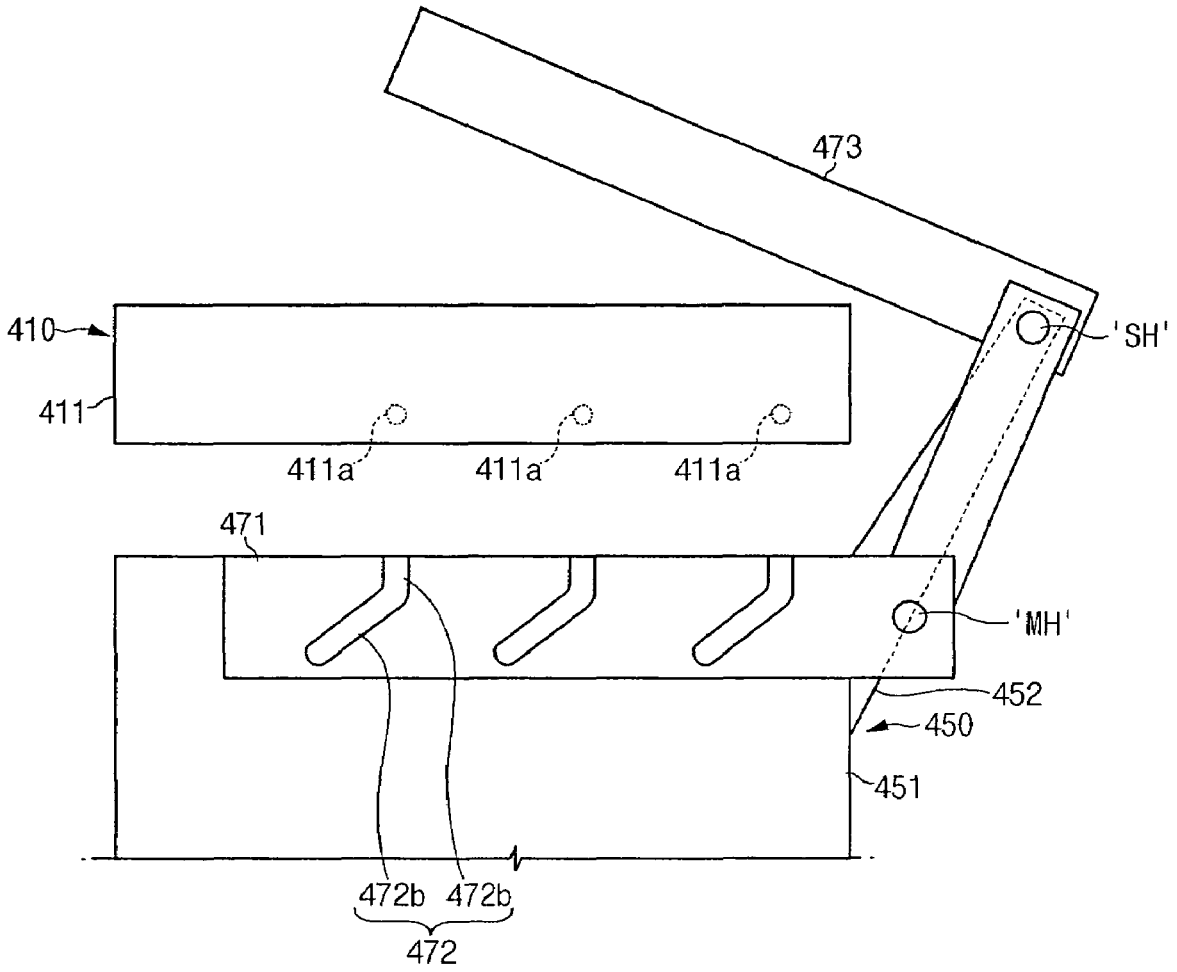
FIG. 8 is a schematic view showing a junction box assembly according to a variation of the second embodiment of the present invention.

As shown in FIG. 8, a junction box assembly according to a variation of the second embodiment of the present invention may be similar to the second embodiment of the present invention, except for the location of slider 471, the location of a guide projection 411*a*, and the location of an indirect pressing lever 473. Accordingly, hereinafter, these locations will be generally described.

The slider 471 may be disposed on a lower cover 450. It is preferable that the slider 471 be disposed on connector 451 of the lower cover 450. The guide projection 411*a* may be disposed on main body 410 corresponding to a projection sliding portion 472 of the slider 471. It is preferable that the guide projection 411*a* be disposed on socket 411 of the main body 410. The indirect pressing lever 473 is similar to the second embodiment of the present invention, except for the location of stationary axle SH. Stationary axle SH may, in this embodiment, be mounted to a bracket 452 extended from the lower cover 450. Since other aspects of the composition and assembly process can be adequately understood through the second embodiment of the present invention previously described, further explanation of such will be omitted.

As has been explained, the junction box assembly according to embodiments of the present invention has a number of advantages. For example, since a bolting device and a bolting process are not required when a junction box is mass-produced, cost and time can thereby be reduced. In addition, since a socket and a connector are accurately coupled to each other, improper assembly is eliminated or reduced. Also, since a bolting procedure is not required when the junction box is repaired, repair work can be simplified. In addition, according to an embodiment of the present invention, since a locking portion is provided, although an external vibration is continuously generated, coupling force can be continuously maintained. All the advantages described in the specification are inclusive.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A junction box assembly, comprising:

a main body on which an electric circuit is disposed, and having at least one socket electrically connected to the electric circuit;

a first cover covering one surface of the main body on which the electric circuit is disposed;

a second cover covering another surface of the main body opposite to said one surface, and having a connector corresponding to the at least one socket; and a coupling unit fastening the main body and the second cover together by a sliding motion thereof such that the socket and the connector are coupled to each other, wherein the coupling unit comprises:

at least one guide projection disposed on the second cover;

a slider slidably disposed on the main body corresponding to the guide projection;

a projection sliding portion disposed on the slider correspondingly to the guide projection, and having a slot inclined at a predetermined angle such that the guide projection perpendicularly moves with respect to a direction of movement of the slider according to movement of the slider; and a pressing portion for moving the slider, said pressing portion comprising:

a linking bar having an end pivotally coupled to an end of the slider by a dynamic axle; and an indirect pressing lever fixed to another end of the linking bar with a predetermined angle therebetween, wherein a fixed portion is pivotally coupled to the main body by a stationary axle, such that, when the indirect pressing lever is pressed, the linking bar rotates with respect to the stationary axle and accordingly moves the dynamic axle and the slider.

2. The junction box assembly of claim 1, wherein an insertion cavity having a depth at least approximately corresponding to the guide projection is defined in the projection sliding portion, such that the guide projection may be smoothly inserted in the projection sliding portion for assembly.

3. The junction box assembly of claim 1, wherein the predetermined angle of the slot is an angle that enables the socket of the main body and the connector of the second cover to be coupled together by a movement of the slider after the guide projection is inserted to the slot.

4. The junction box assembly of claim 1, wherein a pressing direction of the indirect pressing lever is either an upward direction or a downward direction with respect to the main body, and wherein a direction of movement of the dynamic axle and the slider according to the upward or the downward direction is either a left direction or a right direction with respect to the main body.

5. The junction box assembly of claim 1, wherein an insertion slot is further formed at said end of the slider, such that the dynamic axle is inserted therein and is movable in a predetermined distance.

* * * * *